United States Patent [19]

Wallace

[11] Patent Number: 4,809,815

[45] Date of Patent: Mar. 7, 1989

[54] HAND CLIMBER FOR HUNTING USES

[76] Inventor: Donald R. Wallace, 2508 Ruby La., Wadesville, Ind. 47638

[21] Appl. No.: 183,630

[22] Filed: Apr. 19, 1988

[51] Int. Cl.[4] ..... A63B 27/00

[52] U.S. Cl. ..... 182/133; 182/187

[58] Field of Search ..... 182/133, 134, 135, 136, 182/187, 188; 24/188

[56] References Cited

U.S. PATENT DOCUMENTS

| | | | |
|---|---|---|---|
| 2,738,561 | 3/1956 | Trilling | 24/188 |
| 2,842,300 | 7/1958 | Johnson | 182/133 |
| 3,788,492 | 1/1974 | Kraft | 24/188 |
| 3,938,620 | 2/1976 | Nothiger | 182/135 |
| 3,955,645 | 5/1976 | Dye | 182/135 |
| 4,168,765 | 9/1979 | Ferguson | 182/135 |
| 4,445,877 | 5/1984 | Love | 24/188 |
| 4,595,076 | 6/1986 | Gober | 182/187 |
| 4,648,483 | 3/1987 | Skyba | 182/187 |

*Primary Examiner*—Reinaldo P. Machado
*Attorney, Agent, or Firm*—Warren D. Flackbert

[57] ABSTRACT

A hand climber for hunter's use characterized by a vertical support mounting a flexible band and including a latching arrangement for lengthening and/or shortening the amount of usable band. An outwardly extending handle, for user grasping, is secured onto the support and, as well, a brace extends between the handle and the support, where the latter has an outwardly bent lower end portion adapted to bear against the bark of the tree trunk without a damaging effect.

5 Claims, 2 Drawing Sheets

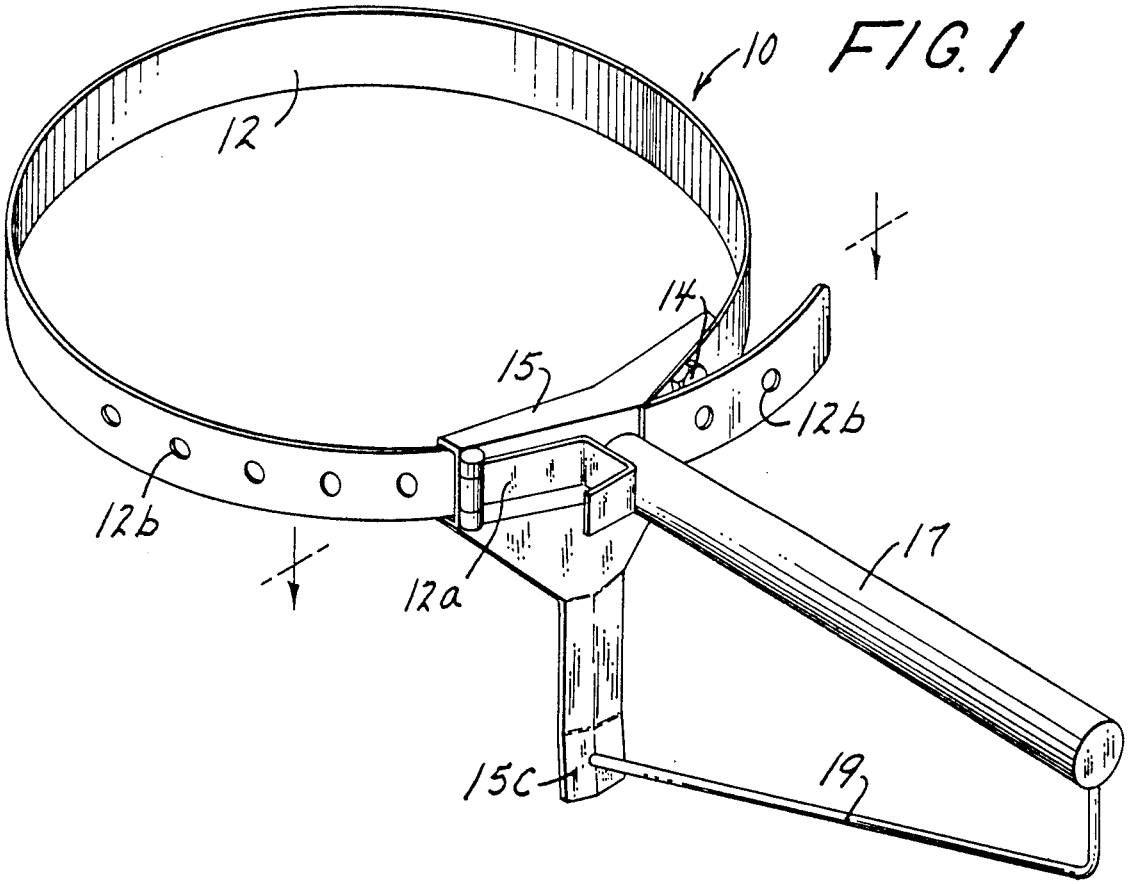
FIG. 1
FIG. 2
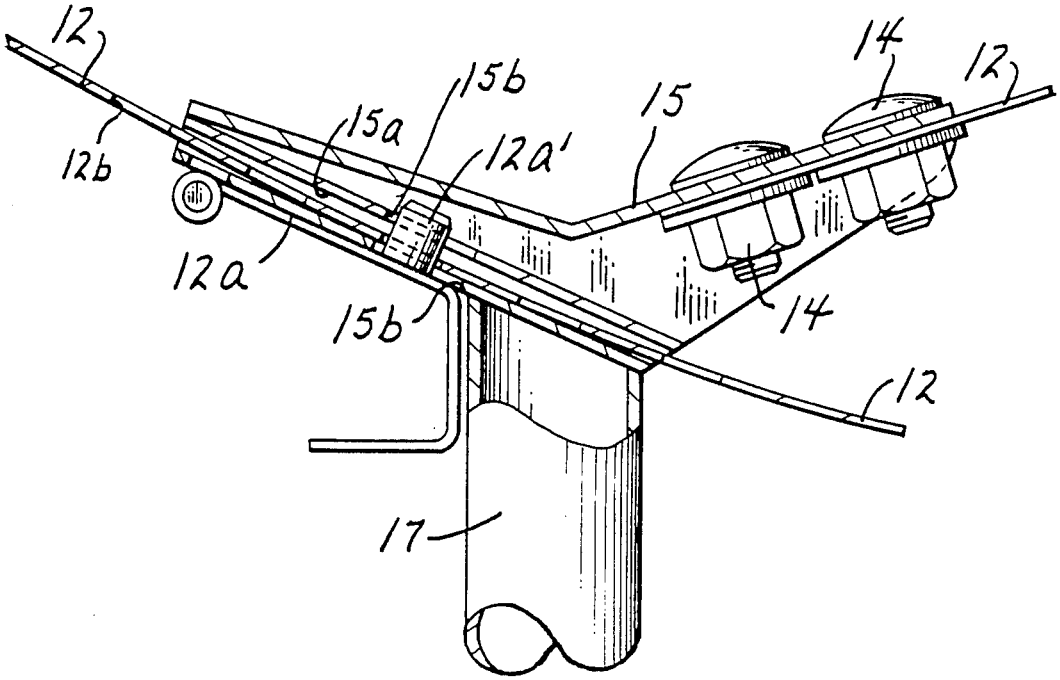

HAND CLIMBER FOR HUNTING USES

As is known, the popularity of deer hunting, for example, is widespread, where, in such instance, a climbing blind is typically employed. The latter, located on a tree, permits the hunter to be stationed at an elevated position with respect to the stalked animals, providing, thereby, a better target range for the marksman.

The need arises for readily establishing the aforesaid climbing blind at a desired height, where the procedures currently in use represent awkwardness and undue time involvement. The invention satisfies such a need in providing a hand climber which permits effective incremental vertical movement for the user and, at the same time, the positive holding of the user while adjusting the climbing blind.

More specifically, the instant hand climber includes a framework having a vertical support which mounts a band (the latter encircling the trunk of a tree), means for tensioning and locking the band at a particular location, an outwardly extending handle, and a brace extending between the aforesaid handle and the vertical support, where the latter includes an outwardly bent lower end for tree bark protection.

In other words, the hand climber of the invention is used together with a conventional climbing blind where vertical movement is achieved in small increments, i.e. first the hand climber is raised (or lowered) and, thereafter, the climbing blind repositioned. The operational sequence represents successive steps until a desired elevation is accomplished.

DESCRIPTION OF THE FIGURES

A better understanding of the present invention will become more apparent from the following description, taken in conjunction with the accompanying drawings, wherein FIG. 1 is a perspective view of a hand climber in accordance with the teachings of the present invention;

FIG. 2 is a horizontal view, partly fragmentary and partly in section, looking in the direction of the arrows on FIG. 1, detailing the instant hand climber; and, FIGS. 3 and 4 are operational views showing the instant hand climber during use conditions.

Figure 3:
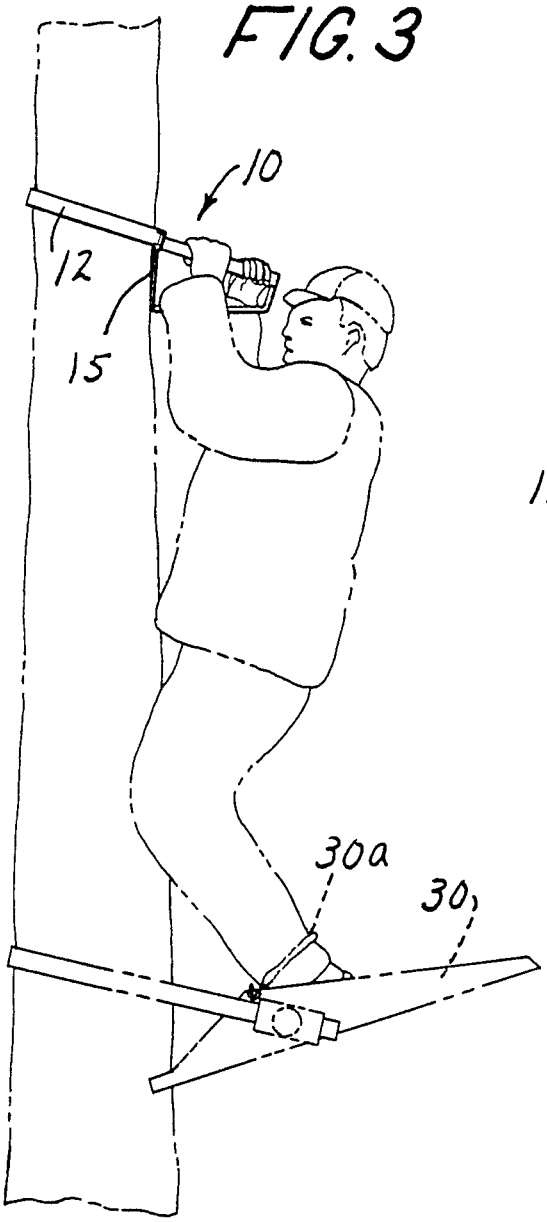

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIGS. 1 and 3, the hand climber 10 of the invention is defined by a flexible band 12 which serves to encircle the trunk of a tree (shown in phantom in FIGS. 3 and 4), where one end of such is fastened, as by nut and bolt means 14, to a vertical support 15 and the other end extends through a channelway 15*a* defined in such vertical support 15. A band 12 latching arrangement 12*a*, pivotally amounted to the vertical support 15, includes a projection 12*a*′ which extends through openings 15*b* in the channelway 15*a* and through one of a plurality of openings 12*b* in the band 12. In other words, slidable movement of band 12, coupled with securement of the latching arrangement 12*a*, serves to accommodate differences in tree trunk diameter.

A handle 17 extends outwardly (with respect to the tree trunk and the vertical support 15), where a brace member 19 extends downwardly from such handle 17 and rearwardly into securement with a lower outwardly angled end 15*c* of vertical support 15. The latter relationship is provided so as to prevent damage to the tree bark during usage of the hand climber 10.

Figure 4:
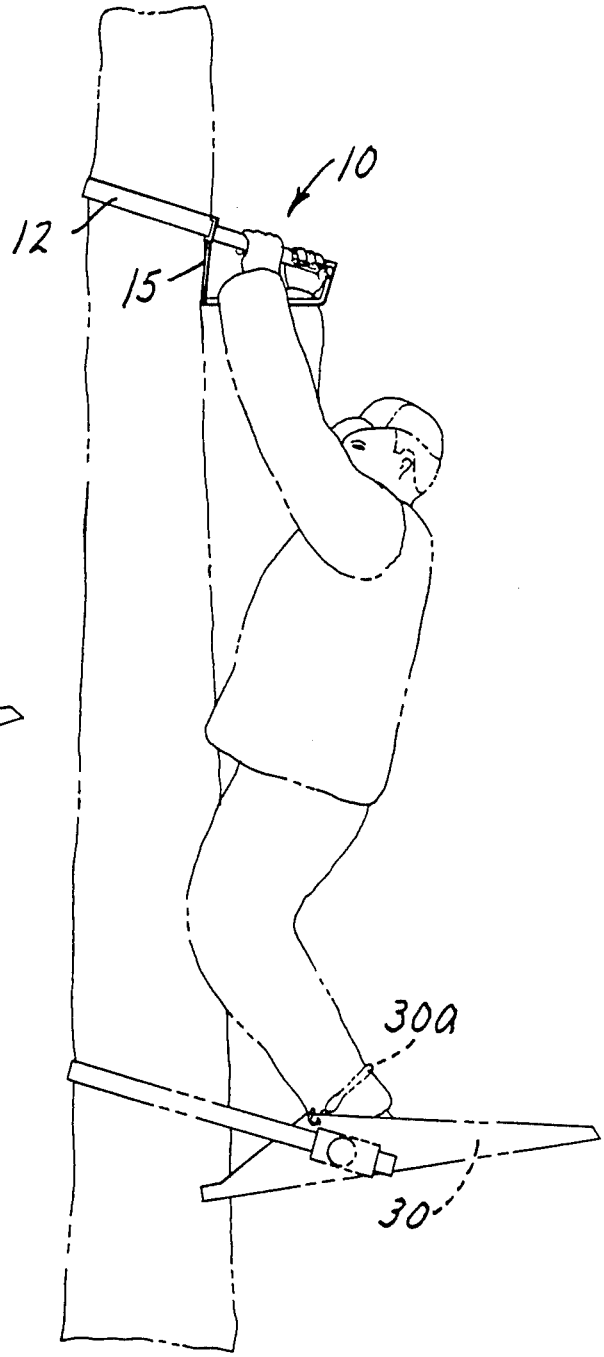

In any event, and looking now at FIGS. 3 and 4, the hand climber 10 of the invention is disposed around the tree trunk and the band 12 tightened to achieve positive positioning. As evident, the climbing blind 30 (shown in phantom) is positioned below the hand climber 10. In other words, with the user standing on the climbing blind 30, the hand climber 10 is successively, in steps, moved upwardly (or downwardly), and, at the same time, the climbing blind 30 caused to move upwardly (for shooting use) until the desired location, in height, is obtained.

While not a part of the invention, the vertical movement of the climbing blind 30 is caused by pivotal action due to straps 30*a* around the legs of the user. In other words, the climbing blind 30 is caused to pivot, and as the user clings to the hand climber 10 of the invention, the climbing blind 30 is jimmied upwardly (or downwardly) in successive steps. Return of the climbing blind 30 to the positions shown in FIGS. 3 and 4, i.e. by clockwise rotation, serves to engage and position the climbing blind 30 on the tree.

From the preceding, it should be evident that the hand climber 10 herein provides effective securement for the user while repositioning the climbing blind 30. Damage to the tree bark is precluded, and, moreover, versatility is achieved through the latching of the band 12 to accommodate tree trunk diameter.

The hand climber described herein is susceptible to various changes within the spirit of the invention, including, for example, proportioning; the configuration of the brace member; the manner of latching the band to accommodate tree trunk diameter; the configuration of the vertical support; and, the like. Thus, the preceding should be considered illustrative and not as limiting the scope of the following claims:

I claim:

1. A hand climber structure comprising a support member including a channelway, said channelway having in-line openings therethrough, a flexible band having one end secured to said support member and another end extending through said channelway, means tensioning and locking said flexible band at an encircling position, and a handle extending outwardly from said support member and away from said flexible band.

2. The hand climber structure of claim 1 where said support member has a lower end angling outwardly away from said flexible band.

3. The hand climber structure of claim 1 where said tensioning and locking means is a pivotal latch having a portion extending through said in-line openings in said channelway and an opening in said flexible band.

4. The hand climber structure of claim 3 where said pivotal latch is mounted on said support member.

5. The hand climber structure of claim 1 where a brace member extends between said handle and said angling lower end of said support member.

* * * * *